US007866502B2

(12) United States Patent
Maxwell

(10) Patent No.: US 7,866,502 B2
(45) Date of Patent: Jan. 11, 2011

(54) VENTING CONTAINER

(75) Inventor: Jason R. Maxwell, Elgin, IL (US)

(73) Assignee: The Glad Products Company, Oakland, CA (US)

( * ) Notice: Subject to any disclaimer, the term of this patent is extended or adjusted under 35 U.S.C. 154(b) by 595 days.

(21) Appl. No.: 11/916,522

(22) PCT Filed: Jun. 5, 2006

(86) PCT No.: PCT/US2006/021810

§ 371 (c)(1),
(2), (4) Date: Dec. 17, 2007

(87) PCT Pub. No.: WO2007/001749

PCT Pub. Date: Jan. 4, 2007

(65) Prior Publication Data

US 2008/0197134 A1 Aug. 21, 2008

(51) Int. Cl.
*B65D 41/16* (2006.01)
*B65D 51/16* (2006.01)
*B65D 41/18* (2006.01)

(52) U.S. Cl. ..... 220/366.1; 220/4.21; 220/360; 220/794

(58) Field of Classification Search ..... 220/4.21, 220/794, 360, 366.1
See application file for complete search history.

(56) References Cited

U.S. PATENT DOCUMENTS 1,843,918 A * 2/1932 Cornell ..... 220/366.1
2,272,018 A 2/1942 Nicholas
2,772,018 A 11/1956 Weiss
3,339,786 A * 9/1967 Biglin ..... 220/781
3,516,572 A * 6/1970 Davis ..... 220/781
4,910,032 A 3/1990 Antoon, Jr.
5,025,948 A * 6/1991 Fixon ..... 220/360
5,046,331 A 9/1991 O'Neal et al.
5,165,947 A 11/1992 Colucci et al.

(Continued)

*Primary Examiner*—Anthony Stashick
*Assistant Examiner*—Niki M Eloshway
(74) *Attorney, Agent, or Firm*—David Peterson

(57) ABSTRACT

A venting container including a lid and base having an inner cavity and a side wall that terminates in a rim, the lid including a central panel and a peripheral sealing lip that surrounds the panel, the peripheral sealing lip having a generally inverted U-shaped cross section that defines a lid channel into which the container rim fits, the sealing lip including at least one venting feature in the form of a flexible venting button that is adapted to transition from a first position to a second position upon application of an actuation force, the venting button being further adapted and positioned whereby when the container rim is positioned in the lid channel and the venting button is in the first position, sealed engagement of the lid to the container is effectuated and when the venting button is in the second position a venting air passage is provided from the container cavity to the container surroundings. In a second embodiment, the venting feature is in the form of a downwardly protruding venting boss provided to the lid closure and a boss seat formed in the base closure whereby the venting boss is received with the boss seat when the lid is oriented in a first non venting attachment position and the venting boss abuts against a surface of the base closure to provide a vent passage between the lid and base upon removal and repositioning of the lid to a second venting attachment position.

14 Claims, 7 Drawing Sheets

U.S. PATENT DOCUMENTS

| | | | | |
|---|---|---|---|---|
| 5,354,569 | A | 10/1994 | Brown et al. | |
| 5,377,860 | A * | 1/1995 | Littlejohn et al. | 220/790 |
| 5,587,192 | A * | 12/1996 | Beizermann | 426/118 |
| 5,759,650 | A | 6/1998 | Raines et al. | |
| 5,916,615 | A | 6/1999 | Brady et al. | |
| 6,013,293 | A | 1/2000 | De Moor | |
| 6,105,810 | A | 8/2000 | Daenen et al. | |
| 6,170,696 | B1 | 1/2001 | Tucker et al. | |
| 7,063,231 | B2 * | 6/2006 | Stanos et al. | 220/793 |
| 7,357,272 | B2 * | 4/2008 | Maxwell | 220/785 |
| 2003/0155354 | A1 * | 8/2003 | Tucker | 220/4.24 |
| 2005/0082305 | A1 * | 4/2005 | Dais et al. | 220/785 |
| 2006/0151512 | A1 * | 7/2006 | Van Heugten et al. | 220/826 |
| 2007/0007298 | A1 * | 1/2007 | Tucker et al. | 220/791 |
| 2008/0073366 | A1 * | 3/2008 | Backaert | 220/785 |

* cited by examiner

VENTING CONTAINER

FIELD OF THE PRESENT INVENTION

The present invention relates generally to food storage containers. More particularly, the invention relates to a food storage container including a lid, a base and a venting feature.

BACKGROUND OF THE INVENTION

Food storage containers are well known in the art. The noted containers generally include a lid that is selectively detachable from a bowl and are commonly designed to provide a variety of features, including being reusable, disposable, microwavable, and the like.

Numerous types of bowl and lid assemblies and means for effecting sealable engagement of a lid on a bowl have been devised. Illustrative are the containers and engagement means disclosed in U.S. Pat. Nos. 6,170,696 and 6,868,980.

One problem associated with conventional, plastic, microwavable containers stems from the rapid temperature changes they must endure. The container must be permitted to vent during microwaving due to the high pressures that arise as moisture in the container contents vaporizes and gas temperatures increase. Thus, the container must be left open to some degree during microwaving. However, it is also desirable to keep the bowl covered as much as possible to prevent the contents from splattering the inside of the microwave.

A further problem often encountered with plastic containers is the poor ability to accommodate a desired amount of produce respiration while maintaining the sealed integrity of the container. As is well known in the art, providing adequate venting (or breathing rate(s)) to accommodate produce respiration can, and in most instances will, enhance produce freshness.

Various methods and container designs have been employed to provide adequate venting of a container during and after microwaving, and to accommodate produce respiration. For example, the prior art is replete with containers that incorporate valves or openable doors in the container base or lid, which allow venting or increased gas exchange. These executions typically result in added cost and complexity in the manufacture of the container. Additionally, venting structure in the form of complex valves with moving parts is difficult to design into a thermoformed plastic part.

A common practice for venting a conventional container is to remove the lid and place it loosely over the container base to accommodate produce respiration and, during microwaving, to allow air and steam to escape. Another common practice for venting a container is to lift a small portion of the lid from engagement with the base (i.e., "crack open" the lid), such as at a corner region of a square or rectangular container. Both of the noted container venting practices will generally accommodate produce respiration. However, in both instances, the container is still subject to leaking, i.e., no longer leak-proof.

The noted container venting practices will usually permit sufficient air and steam to vent during microwaving because the increased pressure within the container will tend to force the container open, increasing any space between the lid and the bowl. There is still a problem, however, with the splattering of food that can occur through any unsealed region between the lid and base. Furthermore, once microwaving is complete, any steam present within the container will cool and the pressure in the container will drop significantly as the pressure differential no longer tends to open the container. The pressure drop creates a vacuum that can suck the lid into a sealed engagement with the base so that sufficient air may not vent back into the container to compensate for the pressure drop. This problem can be aggravated by the accumulation of steam or vapor, which can additionally form a vapor seal between the lid and bowl. The resulting vacuum can permanently damage the container.

It would thus be advantageous to provide a venting container lid having effective, easy to use venting means (i) that is adapted to effectuate sealable engagement of the lid and a container base in a first position and provide an effective air passage when the venting means is in a second position and (ii) can be readily manufactured via a conventional thermoforming process.

SUMMARY OF THE INVENTION

In accordance with one embodiment of the invention, disclosed herein is a reclosable lid for a venting container, the container including a base having an inner cavity and a side wall that terminates in a rim, the lid including a central panel and a peripheral sealing lip that surrounds the panel, the peripheral sealing lip having a generally inverted U-shaped cross section that defines a lid channel into which the container rim fits, the sealing lip is provided with venting means in the form of a flexible venting button that is adapted to transition from a first position to a second position upon application of an actuation force, the venting button being further adapted and positioned whereby when the container rim is positioned in the lid channel and the venting button is in the first position, sealed engagement of the lid to the container is effectuated and when the venting button is in the second position the respective sealing surfaces of the lid and base are displaced relative to one another such that a venting air passage is provided from the container cavity to the container surroundings. The venting button is preferably formed integral with a surface of the lid channel and comprises an eversible dome including a border portion that surrounds a raised portion, the raised portion protruding from a plane defined by the border portion, the raised portion further including an apex that forms an outermost protruding part of the raised portion, the apex adapted to contact a surface of the second closure portion when the venting button is moved into the second position.

In another embodiment, the venting means comprises a second and optionally a third venting button, both of which may be selectively actuated along with actuation of the first venting button to provide an enhanced amount of venting through the closure region of the container.

In accordance with another embodiment of the invention, there is described a venting container comprising a selectively detachable lid, the lid including a central panel and peripheral sealing lip that surrounds the panel, the peripheral sealing lip having a generally inverted U-shaped cross-section that defines a lid channel, the lip including a venting boss; and a container base having an inner cavity, the container base further having a side wall that terminates in a container rim, the container rim being adapted to be positioned in the lid channel, the container rim including a venting boss seat adapted to receive the venting boss when the container rim is positioned in the lip channel and the lid and base are in a first position, whereby sealable engagement of the lid and the base is effectuated, and whereby when the lid is rotated relative to the container to a second position, wherein the venting boss is disposed distal from the venting boss seat, and the container rim is repositioned and in the lip channel a venting air passage is provided from the container cavity to the container surroundings.

The present invention substantially reduces or eliminates the disadvantages and drawbacks associated with prior art container base and lid assemblies. As discussed in detail herein, the container designs of the invention include highly effective, simple to operate venting means that prevent splattering of the container contents during microwaving and that also accommodate produce respiration.

The features of the present invention will become apparent to one of ordinary skill in the art upon reading the detailed description, in conjunction with the accompanying drawings, provided herein.

DETAILED DESCRIPTION OF THE INVENTION

Unless defined otherwise, all technical and scientific terms used herein have the same meaning as commonly understood by one having ordinary skill in the art to which the invention pertains.

Figure 1:
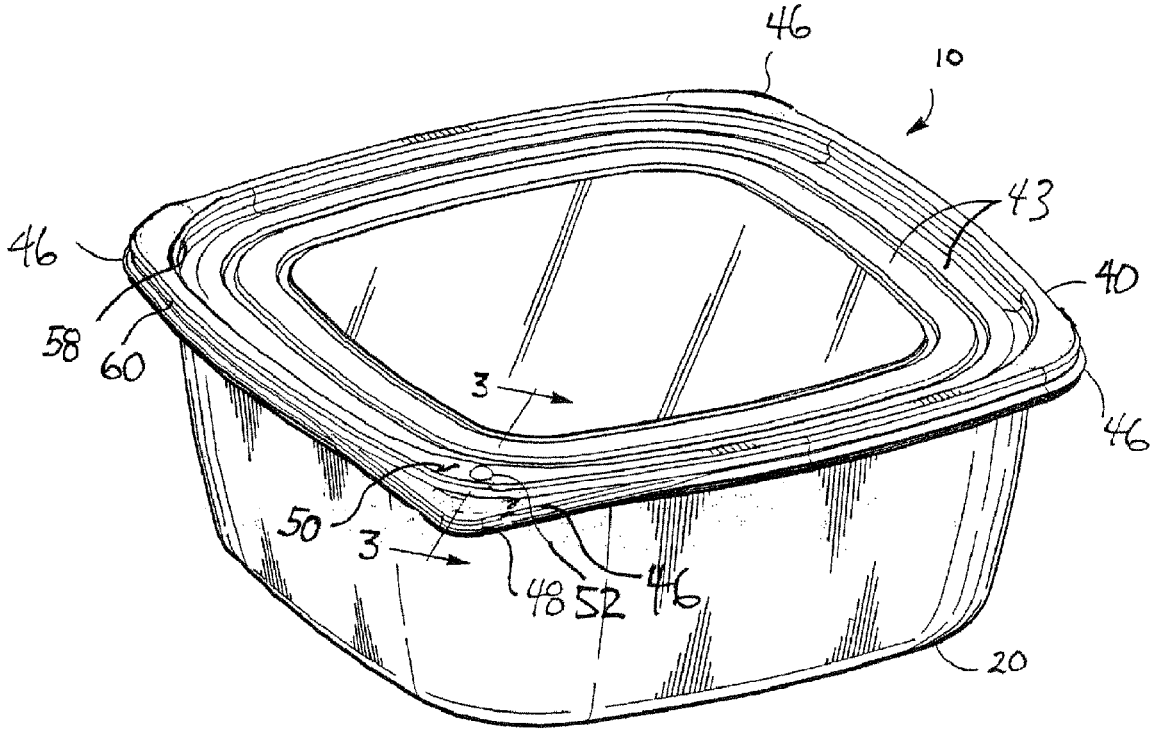
FIG. 1 is a perspective view of a venting container including a lid and a base in accordance with one embodiment of the invention.
Figure 2:
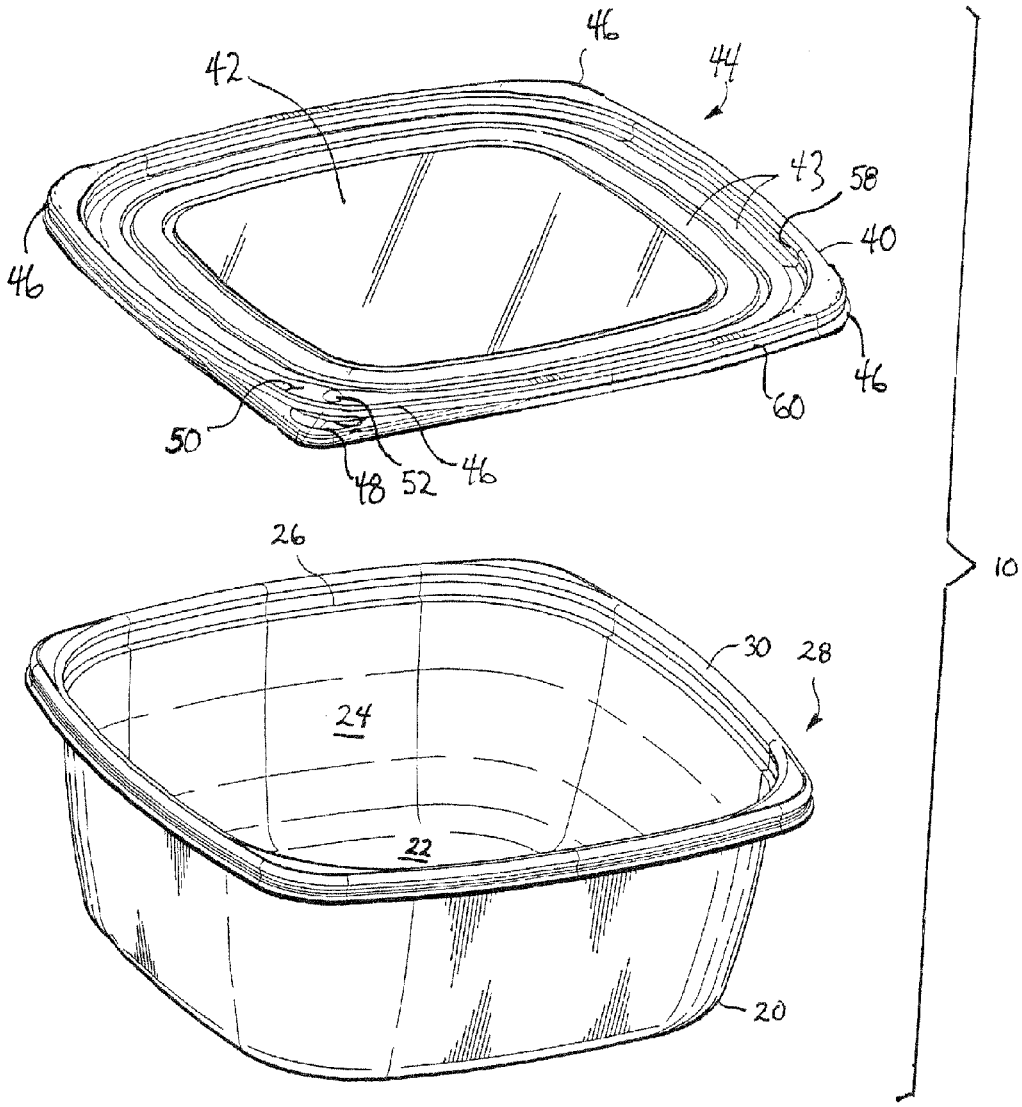
FIG. 2 is an exploded perspective view of the venting container shown in FIG. 1.

Turning to the drawings, wherein like reference numerals refer to like elements, a first embodiment of the present invention is illustrated in FIGS. 1 and 2. A container 10 includes a container base 20 and a flexible container lid 40. In the example shown in the Figures, the container 10 is depicted as substantially square with rounded corners. In other embodiments of the present invention, the container 100 has other shapes such as rectangular, circular, or elliptical.

The container base 20 has a bottom 22 and a sidewall 24 extending from the periphery of the bottom 22. At the termination of the sidewall 24 an outwardly and substantially horizontally extending denesting shoulder 26 is provided, which merges into the base of a closure portion 28. The closure portion 28 has a generally horizontal rim surface 30 and a generally inverted U-shaped cross section. The bottom surface 22 provides a stacking recess (not shown) extending upwardly to a substantially horizontal central panel surface (also not shown).

The container lid 40 is adapted to sealingly engage the container base 20. According to one embodiment of the invention, container lid 40 generally includes a central panel 42 surrounded by a peripheral closure portion or sealing lip 44. The central panel 42 optionally includes one or more stacking beads 43 that cooperate with the stacking recess provided in the bottom surface 22 of the base 20. The lid closure portion 44 includes four corners 46 an optional gripping tab 48. The lid closure portion 44 of the lid 40 is adapted to sealingly engage base closure portion 30. The lid closure portion 44 has a horizontal rim surface 50 disposed between inner and outer walls 58, 60 that together form a generally inverted U-shaped cross section that defines a lid channel. The lid includes venting means which comprises at least one venting button 52. In accordance with a preferred embodiment of the invention the venting button 52 is located along the horizontal rim surface 50 and preferably at a corner region and most preferably at corner region provided with gripping tab 48. Locating the venting button at one corner allows the other three corners of the lid to remain sealed when the container 10 is in a venting configuration, thereby providing the best-vented seal possible. In other embodiments, the venting button 52 may be located medial of the corners 46 or located along the inner or outer walls 58, 60 of the lid channel.

Figure 3:
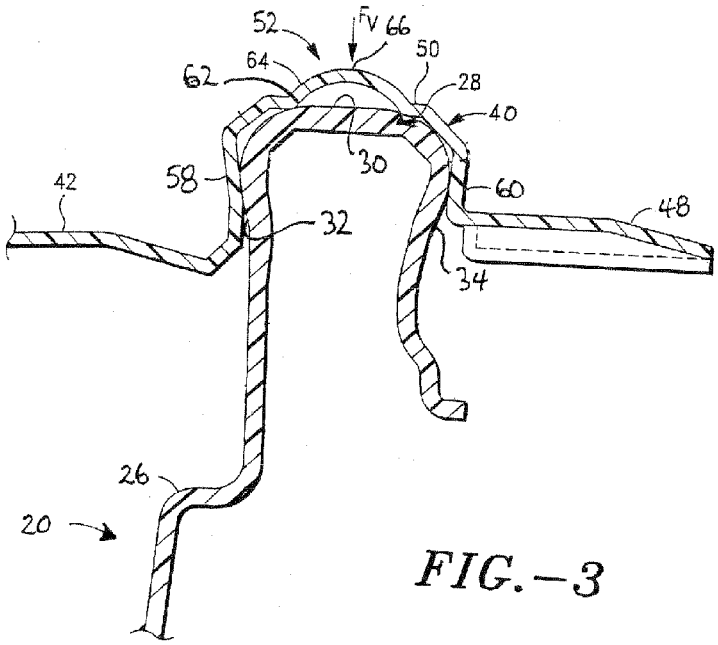
FIG. 3 is a cross sectional view of the venting container taken along the line and in the direction of arrows 3-3 of FIG. 1 which illustrates a first lid venting button in a first non-venting position.
Figure 4:
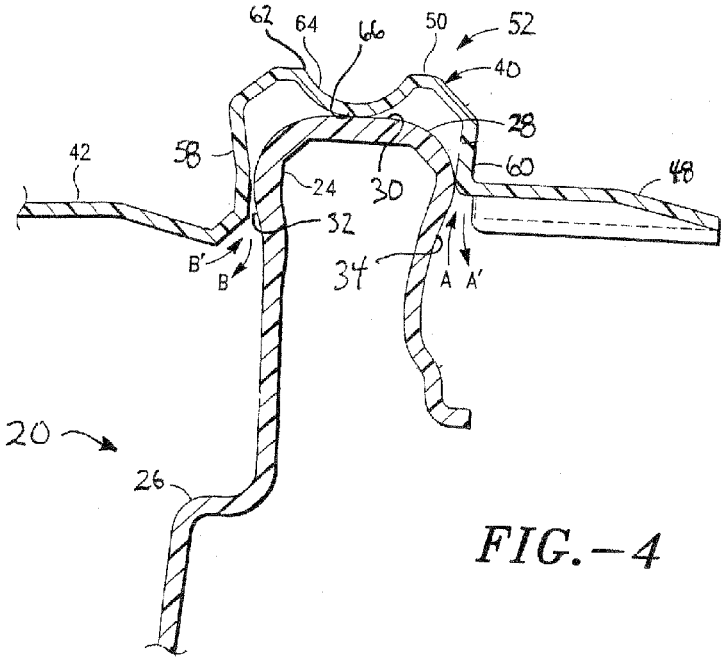
FIG. 4 is a cross sectional view of the venting container similar to FIG. 3 which illustrates the first lid venting button in a second venting position.

Referring now to FIGS. 3 and 4 the closure portion 28 of the container bottom 20 generally includes an inner wall 32 and an outer wall 34 and, as noted previously, the closure portion 44 of the container lid 40 includes inner wall 58 and an outer wall 60. As shown, inner walls 32 and 58 are formed as mating under cuts such that when lid 40 is secured to base 20, the inner wall 32 provides an interference fit with the inner wall 58 of the lid 40. As such, the inner walls 32 and 58 provide a first set of sealing surfaces. Outer walls 34 and 60 may also be formed as mating undercuts to provide a second set of sealing surfaces to provide a container having inside and outside continuous seal regions. Hence, the closure portion or sealing lip 44 of the lid 40 acts as a sealing channel to receive the horizontal rim surface 30 of the closure portion 28 of container base 20. Further details of the above-described closure portions for the lid and base are set forth in U.S. Pat. No. 6,170,696 B1, which is incorporated by reference herein in its entirety. Although the closure design of the preferred embodiment is described as having both inside and outside sealing surfaces, it is understood that the venting features of the present invention may work equally well with other known U-shaped closure configurations such as those generally U-shaped closure designs where the primary sealing contact is generally limited to the mating inner walls (or alternately mating outer walls) of the lid and base closure portions with the respective outer walls (or alternately inner walls) of the lid and base closure portions providing little or no contribution to forming an additional continuous peripheral sealing zone. For example, in the embodiment described, the respective outer walls 34 and 60 need not both be formed as undercuts and either outer wall may be vertically oriented or even slope outward beyond vertical (i.e., opposite to undercut).

The base 20 and lid 40 can be made as thermoformed parts. Alternatively, one or both of these components could be made by other processes, including, for example, blow molding or injection molding. It should be noted, however, that those skilled in the art understand that minor structural modifications likely will occur if a process other than thermoforming is used.

As discussed briefly above, the venting means comprises at least one flexible venting button 52 that is disposed on the closure portion 44. More specifically, the venting button 52 is disposed on the horizontal rim surface 50, as shown in FIGS. 3 and 4. The venting button 52 includes a border portion 62 that surrounds a raised portion 64. The border portion 62 is formed integral with the horizontal rim surface 50. The raised portion 64 may be formed as a rounded or semi-spherical eversible dome protruding from the plane defined by the border portion 62. As a result of its rounded shape, the raised portion 64 includes an apex 66 that forms the outermost protruding part of the raised portion 64 and an inflection region that integrally connects the apex 66 to the border portion 62. Preferably, the raised portion 64 is about one-half the diameter of the border portion 62. In practice, the eversible nature of the raised domed portion 64 may be facilitated by material thinning at the junction between the border portion 62 and the raised portion 64. In accordance with an alternate embodiment wherein the lid is formed as an injection molded part, the thickness of the eversible raised domed portion 64 is preferably less than about 50% of the thickness of adjacent areas the lid as taught in US 2004/0232036 A1 at numbered paragraph 51, which is incorporated herein by reference.

Figure 5:
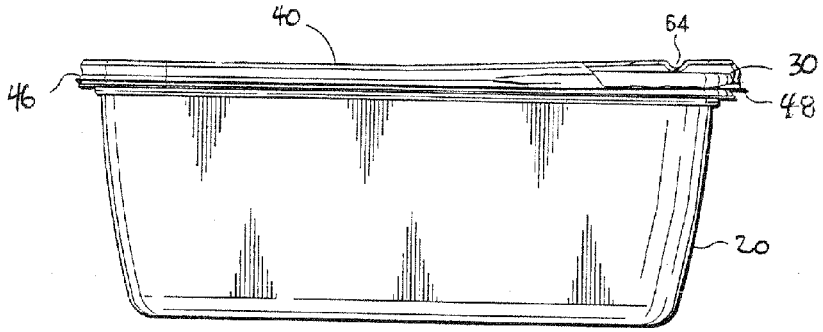
FIG. 5 is a side view of the venting container of FIG. 1 showing in partial section the actuation of the venting button in the second venting position.

The venting button 52 is designed and adapted to be moved between a first, non-venting position as shown in FIG. 3 and a second, venting position as shown in FIG. 4-5. In the first position of the venting button 52 (FIG. 3), the eversible raised portion 64 of the venting button protrudes in a direction away from the horizontal rim surface 30 of the bottom closure portion 28. In this position, the inner walls 32 and 58 remain in sealing contact when the lid 40 is engaged to the base 20. In the second position of the venting button (FIGS. 4 and 5), the raised portion 64 is inverted and faces towards the horizontal rim surface 30 of the bottom closure portion 28. The apex 66 abuts the horizontal rim surface 30 such that inner sealing wall 58 is displaced from sealing contact with inner wall 32 and outer wall 60 is displaced relative to outer wall 34 to provide a venting air passage denoted generally by Arrows A, A' and B, B'. As noted above, the respective outer walls 34 and 60 of the base and lid closure portions need not form a second set of sealing surfaces and could be arranged as vertical or beyond vertical segments as desired.

The venting button 52 is adapted to remain in the first and second positions after placement thereof until an external (or actuation) force $F_v$ is applied to the button 52. As will be appreciated by one having ordinary skill in the art, the actuation force will typically depend on the size of the container closure and button 52, as well as the placement of the button 52 on the lid closure portion 44.

Preferably, the actuation force ($F_v$) is in the range of approximately 0.25-15.0 lbs., more preferably, in the range of approximately 0.5-10.0 lbs., even more preferably, in the range of approximately 1.0-5.0 lbs. As will be appreciated by one having ordinary skill in the art, the noted actuation force is sufficient to maintain the button 52 in a desired venting or non-venting position while providing easy actuation therebetween.

According to the invention, the venting button 52 can comprise various sizes, depending on the size and shape of the container closure. In one embodiment (i.e., closure size ranges from approximately 0.3-0.6 in. proximate the button 52), the venting button 52 is substantially circular in shape and has a diameter in the range of approximately 0.25-0.6 in. In another embodiment, the diameter of the venting button 52 ranges from approximately 0.35-0.55 in.

As stated, the venting button 52 transitions from the first position to the second position a distance sufficient to provide an effective air passage at the second position. The actual transition distance will similarly depend on the size (e.g., horizontal surface width) of the rim surface 50 and venting button 52.

An exemplary venting mode of operation is as follows: a user merely lifts the corner 46 of the lid 40 from the base 20 (if attached thereto) while applying the noted actuation force (denoted by Arrow $F_V$) to the venting button 52 to transition the eversible raised domed portion 64 from the first, non-venting position (FIG. 3) to the second, venting position (FIG. 4). When the venting button 52 is moved into its second venting position, the apex 66 of eversible raised domed portion 64 abuts rim surface 30 of the base closure portion 28 thereby displacing or raising the lid 40 proximate the button 52 a sufficient amount to (i) facilitate produce respiration and/or (ii) during microwaving, permit air and steam to vent from the container and permit sufficient air to vent back into the container 10 during cooling to compensate for the pressure drop.

Figure 6:
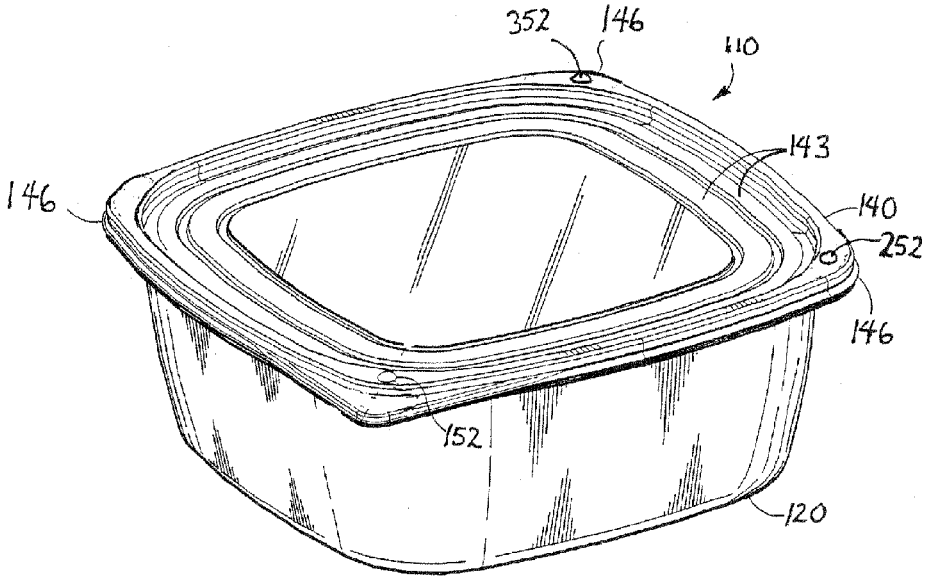
FIG. 6 is a perspective view of another embodiment of the venting container showing a container lid with three venting buttons.

FIG. 6 illustrates another embodiment of the present invention. The container 110 consists of a container base 120 identical to container base 20 as shown in FIGS. 1-5 and a container lid 140. The container lid 140 is substantially identical to the container lid 40 described in FIGS. 1-5 except that in addition to venting button 52 it includes a second venting button 152 and optionally a third venting button 252. Like the first venting button 52, the venting buttons 152 and 252 are preferably located at the corner regions 146 of the lid 140. Operation of venting buttons 152 and 252 is identical to that as previously described in connection with FIGS. 3-5. The venting buttons 52, 152, and 252 may be selectively actuated to provide a desired amount of venting.

FIGS. 7 through 11 illustrate another embodiment of a venting container of the present invention. The container 310 includes a container base 320 and a flexible container lid 340 sealingly engaged thereto. The container base 320 has a bottom 322 and a sidewall 324 extending from the periphery of the bottom 322. At the termination of the sidewall 324 an outwardly and substantially horizontally extending denesting shoulder 326 is provided, which merges into the base of a closure portion 328. The closure portion 328 has a generally horizontal rim surface 330 and a generally inverted U-shaped cross section.

The container lid 340 generally includes a central panel 342 surrounded by a peripheral closure portion or sealing lip 344. The central panel 342 optionally includes one or more stacking beads 343 that cooperate with the stacking recess (not shown) provided in the bottom surface 322 of the base 320. The lid closure portion 344 includes four corners 346 an optional gripping tab 348. The lid closure portion 334 of the lid 340 is adapted to sealingly engage base closure portion 330. The lid closure portion 344 has a horizontal rim surface 350 and a generally inverted U-shaped cross section that defines a lid channel.

Figure 7:
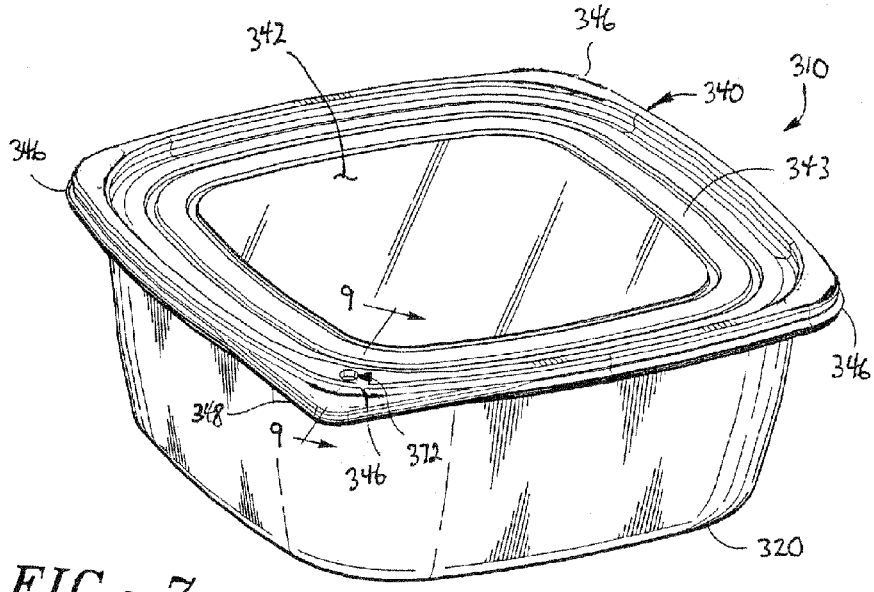
FIG. 7 is a perspective view of a venting container in accordance with another embodiment of the invention.

As illustrated in FIG. 7, the lid 340 further includes venting means, designated generally at 372.

In a preferred embodiment, the venting means 372 comprises at least one protrusion or venting boss 374 that is disposed proximate the lid closure portion 344. The venting boss 374 is disposed on the horizontal rim surface 350 and protrudes into the lid channel as shown in FIGS. 9 and 10.

According to the invention, the venting boss 374 can similarly be disposed at any position on the lid closure portion 344. Preferably, for quadrilaterals the venting boss 374 is disposed proximate a lid corner 346. In a preferred embodiment of the invention, the venting boss 374 is disposed proximate corner 346, which, as illustrated in FIGS. 7, and 9-11 is also proximate the gripping tab 348.

Figure 8:
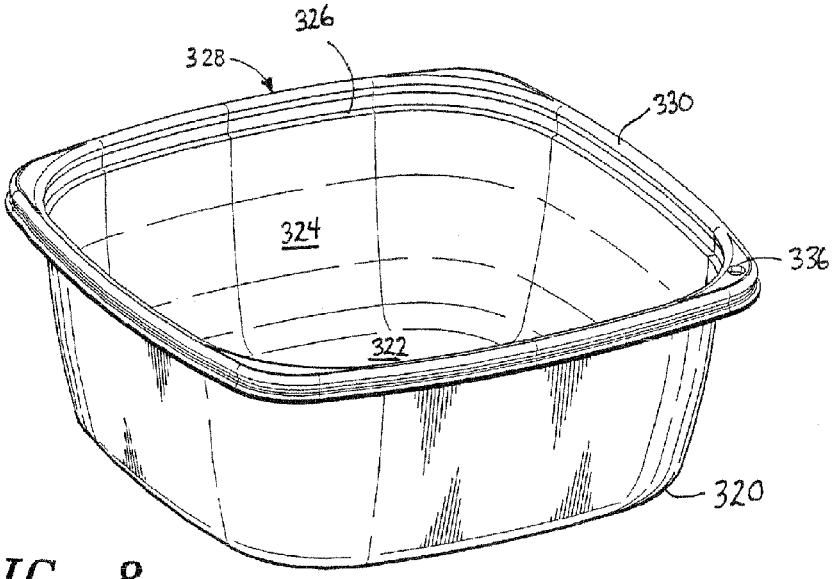
FIG. 8 is a perspective view of the base of the venting container of FIG. 7.
Figure 11:
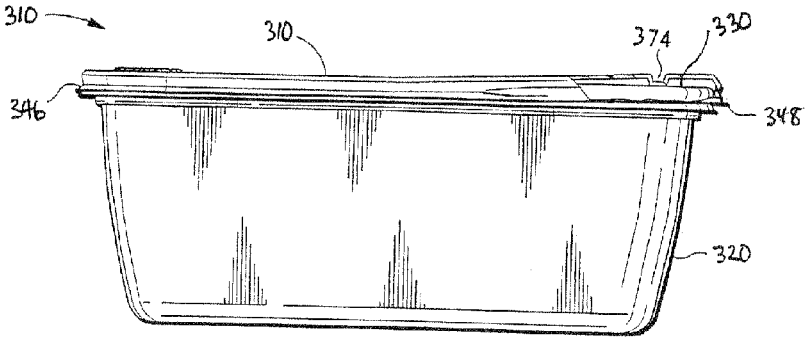
FIG. 11 is a side view of the venting container of FIG. 7 showing in partial section a venting corner region when the lid is in its second venting orientation.
Figure 9:
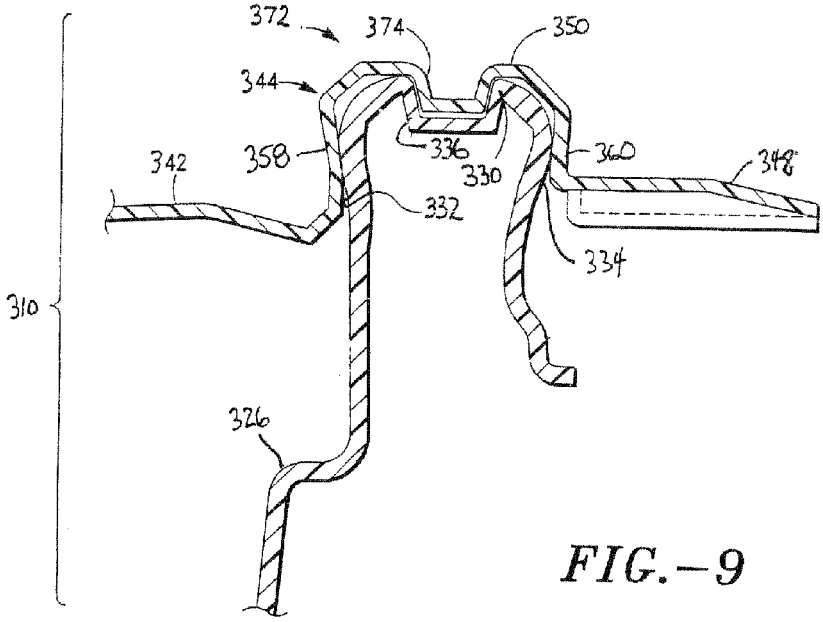
FIG. 9 is a cross sectional view of the venting container taken along line and in the direction of arrows 9-9 of FIG. 7 which illustrates the lid in its first non-venting orientation.
Figure 10:
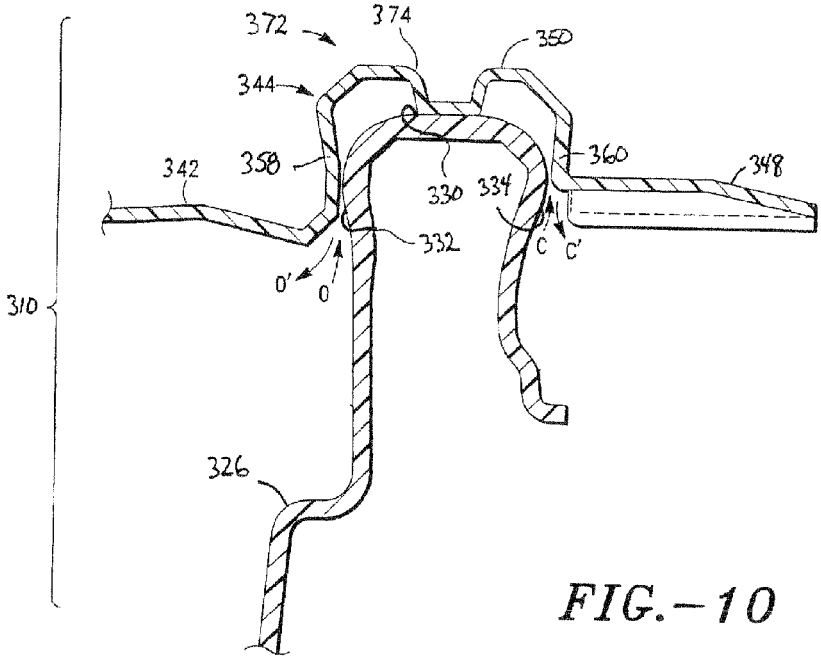
FIG. 10 is a cross sectional view similar to FIG. 9 which illustrates the lid in its second venting orientation.

As illustrated in FIGS. 8 and 9, the container bottom 320 includes a venting boss seat 336 adapted to receive the venting boss 374 when the lid 340 and the base 320 are in an engaged position and the lid 340 and, hence, venting boss 374 are oriented in a first non-venting position. When the lid 340 is rotated to or oriented in a second venting position, the venting boss 374 seats on the container horizontal rim surface 330, as illustrated in FIGS. 10 and 11, whereby the lid 340 is slightly raised proximate the boss 374 and similarly provides a venting air passage. In this second venting position, inner wall 358 of the lid closure portion 344 is displaced and disengaged from sealing contact with inner wall 332 of the base closure portion 328 and outer wall 360 of the lid closure portion 344 is displaced relative to outer wall 334 of the base closure portion 328 to provide a venting air passage denoted generally by Arrows O, O' and C, C'.

According to the invention, the venting boss 374 can similarly comprise various sizes, depending on the size and shape of the container closure. In a preferred embodiment (i.e., closure size in the range of approximately 0.3-0.6 in. proximate the boss 374), the venting boss 374 is substantially circular in shape and has a diameter in the range of approximately 0.25-0.6 in., more preferably, in the range of approximately 0.35-0.55 in.

To place the container 310 in a venting orientation, a user merely removes the lid 340 from the container base 320, rotates and places the lid 340 back on the container base 320 in a venting position as shown in FIGS. 10 and 11. For a square container the lid 340 need only be rotated by 90° to allow venting. For a rectangular container, the lid 340 requires a rotation of 180° to move to the venting position. In the noted venting position, the venting boss 374 similarly raises a corner 346 of the lid 340, which (i) accommodates produce respiration and/or (ii), during microwaving, permits air and steam to vent from the container and allows sufficient air to vent back into the container during cooling to compensate for the pressure drop, while substantially maintaining the sealed integrity (i.e., leak-proof) of the container 310.

To place the container 310 back into the fully sealed non-venting orientation, the user merely removes and rotates the lid 340 to align the venting boss 374 with the venting boss seat 336 and then depresses the lid onto the base to sealingly engage the lid closure portion 344 with the base closure portion 328.

The container can be reusable, but it can also be constructed cheaply enough that consumers see it as a disposable item, with replacement covers and bases available separately for retail sale. The base and the cover can be fabricated by thermoforming a clarified polypropylene homopolymer material. In another embodiment, the container may be fabricated by thermoforming a clarified random copolymer polypropylene material. Other plastic materials which would be suitable for fabricating the container by thermoforming include PS (polystyrene), CPET (crystalline polyethylene terephthalate), APET (amorphous polyethylene terephthalate), HDPE (high density polyethylene), PVC (polyvinyl chloride), PC (polycarbonate), and foamed polypropylene. The material used can be generally transparent to allow a user to view the contents of the container.

The container may include a visual indication of closure between the container cover and the container base. The visual indication may be a color change in the area where the cover engages the base. In one embodiment, the closure portion on the cover may be a first color and the closure portion on the base may be a second color. When the closure portions are engaged, the first and second colors produce a third color which is visible to the user to indicate that the container is sealed.

The container may include a rough exterior surface to reduce slipping and to improve grasping by the user, especially if the user's hands are wet or greasy.

The container may be divided to separate foods in the container. A divider may be integral with the container or may be a separate component. Either the base only may include a divider or both the base and the cover may each include a divider. The divider located in the cover may only partially engage the divider in the base so as to provide splash protection, or it may fully engage the divider in the base to provide varying degrees of inter-compartmental leak resistance.

The container may include a strip indicating the temperature of the container and its contents.

The gripping tab can include a relieved portion that provides less interference contact with the base during the removal or engagement of the cover while still providing an adequate closure portion to maintain proper sealing of the container. The relieved portions of the gripping tab permit venting by allowing a portion of the cover to be unsealed from the base while still maintaining a seal around the remaining perimeter of the container. This feature is useful in microwave cooking where the cover prevents food from splattering onto the inside surface of the microwave while still allowing the container to vent. By using the gripping tab, less force is required to remove the cover from the base. This lower opening force also reduces the possibility of container failure from stress and fatigue. The lower opening force can improve the ability of the user to maintain control over the container components while removing the cover from the base and thus to reduce the possibility of spilling the contents stored in the container.

The use of the terms "a," "an," "the," and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise indicated.

While the invention is described herein in connection with certain preferred embodiments, there is no intent to limit the present invention to those embodiments. On the contrary, it is recognized that various changes and modifications to the described embodiments will be apparent to those skilled in the art upon reading the foregoing description, and that such changes and modifications may be made without departing from the spirit and scope of the present invention. Skilled artisans may employ such variations as appropriate, and the invention may be practiced otherwise than as specifically described herein. Accordingly, the intent is to cover all alternatives, modifications, and equivalents included within the spirit and scope of the invention. Moreover, any combination of the above-described elements in all possible variations thereof is encompassed by the invention unless otherwise indicated herein or otherwise clearly contradicted by context.

What is claimed is:

1. A venting container comprising a container lid and a container base:

the container lid including a central panel and a peripheral first closure portion surrounding the panel, the first closure portion having a first sealing surface;

the container base including a bottom, a peripheral side wall extending from the bottom, an open top, and a second closure portion with a second sealing surface, wherein said first closure portion comprises a sealing lip having a generally inverted U-shaped cross section that defines a lid channel into which the second closure portion is received and the second closure portion being engageable with the first closure portion such that the respective sealing surfaces are brought into sealing contact to define a leak proof storage area; and the first closure portion further including a first venting button operable to move between a first position and a second position such that upon engagement of the first and second closure portions the respective sealing surfaces remain in sealing contact when said venting button is in the first position and the first sealing surface is displaced an amount relative to the second sealing surface in the vicinity of the first venting button to provide a desired amount of venting when said venting button is in the second position, wherein the venting button is formed integral with a surface of the lid channel and comprises a reversible dome including a border portion that surrounds a raised portion, the raised portion protruding from a plane defined by the border portion, the raised portion further including an apex that forms an outermost protruding part of the raised portion, the apex adapted to contact a surface of the second closure portion when the venting button is moved into the second position.

2. The container of claim 1 wherein the container lid includes at least one gripping tab and the first venting button is located proximate to the gripping tab.

3. The container of claim 1 wherein the container lid comprises thermoformed plastic.

4. The container of claim 1 wherein the container lid comprises injection-molded plastic.

5. The container of claim 1 wherein the first venting button is movable between the first and second positions upon application of an actuation force by a user in the range of 0.25-15.0 lbs.

6. The container of claim 1 wherein the first closure portion includes a second venting button.

7. The container of claim 6 wherein the first closure portion includes a third venting button.

8. A venting container lid comprising:

a central panel;

a peripheral first closure portion surrounding the panel, the first closure portion adapted for sealing engagement with a corresponding closure structure of a container base wherein said first closure portion comprises a sealing lip having a generally inverted U-shaped cross section that defines a lid channel into which the corresponding structure of the container base is received; and the first closure portion further including a first venting button operable to move between a first position and a second position whereby a sealed engagement between the first closure portion and the corresponding closure structure of the container base is maintained when the venting button is in the first position and a vent is provided between the first closure portion and the corresponding closure structure of the container base when the venting button is in the second position wherein the venting button is formed integral with a surface of the lid channel and comprises a reversible dome including a border portion that surrounds a raised portion, the raised portion protruding from a plane defined by the border portion, the raised portion further including an apex that forms an outermost protruding part of the raised portion, the apex adapted to contact a surface of the corresponding closure structure of the container base when the venting button is moved into the second position.

9. The container lid of claim 8 wherein the container lid includes at least one gripping tab and the first venting button is located proximate to the gripping tab.

10. The container lid of claim 8 wherein the container lid comprises thermoformed plastic.

11. The container lid of claim 8 wherein the container lid comprises injection-molded plastic.

12. The container lid of claim 8 wherein the first venting button is movable between the first and second positions upon application of an actuation force by a user in the range of 0.25-15.0 lbs.

13. The container lid of claim 8 wherein the first closure portion includes a second venting button.

14. The container of claim 13 wherein the first closure portion includes a third venting button.

* * * * *